US009108293B2

(12) United States Patent
Nunley, Jr. et al.

(10) Patent No.: US 9,108,293 B2
(45) Date of Patent: Aug. 18, 2015

(54) METHOD FOR CHEMICAL MECHANICAL POLISHING LAYER PRETEXTURING

(75) Inventors: John Henry Nunley, Jr., Elkton, MD (US); Andrew M Geiger, Newark, DE (US); Jeffrey Benedict, Townsend, DE (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 270 days.

(21) Appl. No.: 13/561,282

(22) Filed: Jul. 30, 2012

(65) Prior Publication Data

US 2014/0030961 A1 Jan. 30, 2014

(51) Int. Cl.
*B24B 53/017* (2012.01)
*B24B 7/22* (2006.01)

(52) U.S. Cl.
CPC ..... *B24B 53/017* (2013.01); *B24B 7/228* (2013.01)

(58) Field of Classification Search
CPC .... B24B 53/017; B24B 21/04; B24B 37/042; B24B 53/12; B24B 21/12; B24B 49/04; B24B 53/14; B24D 3/32; B24D 11/00; B24D 15/04; B24D 7/12
USPC ..... 451/56
See application file for complete search history.

(56) References Cited

U.S. PATENT DOCUMENTS 3,701,219 A * 10/1972 Sternal ..... 451/300
3,777,442 A * 12/1973 Bernu ..... 451/303
4,178,721 A * 12/1979 Evans ..... 451/301
4,503,642 A * 3/1985 Wilms ..... 451/301
4,546,572 A * 10/1985 Fischer ..... 451/24
4,569,155 A * 2/1986 Fischer et al. ..... 451/300
4,594,815 A * 6/1986 Mickelson et al. ..... 451/300
5,512,009 A * 4/1996 Earl ..... 451/300
5,527,424 A * 6/1996 Mullins ..... 438/692
5,547,448 A * 8/1996 Robertson ..... 492/16
5,895,312 A * 4/1999 Covert et al. ..... 451/8
6,089,958 A * 7/2000 Costa et al. ..... 451/59
6,117,000 A * 9/2000 Anjur et al. ..... 451/526
6,126,532 A * 10/2000 Sevilla et al. ..... 451/526
6,300,247 B2 * 10/2001 Prabhu ..... 438/691
6,520,833 B1 * 2/2003 Saldana et al. ..... 451/5
6,641,470 B1 * 11/2003 Zhao et al. ..... 451/523
6,645,050 B1 * 11/2003 Butterfield et al. ..... 451/41
6,656,025 B2 * 12/2003 Pant et al. ..... 451/56
6,656,030 B2 * 12/2003 Xu et al. ..... 451/526
6,679,763 B2 * 1/2004 Boyd et al. ..... 451/56
6,722,960 B2 * 4/2004 Brooks ..... 451/65
6,726,530 B2 * 4/2004 Mikhaylich et al. ..... 451/8

(Continued)

OTHER PUBLICATIONS

Radial Clearance of a Bearing http://bearingsindustry.com/aboutbearing/radial.htm.*

(Continued)

*Primary Examiner* — Joseph J Hail
*Assistant Examiner* — Brain Keller
(74) *Attorney, Agent, or Firm* — Thomas S. Deibert

(57) ABSTRACT

A method for pretexturing the polishing surface of a chemical mechanical polishing layer, comprising providing a chemical mechanical polishing layer having a polishing surface; providing a belt sanding machine; feeding the chemical mechanical polishing layer through a gap between a transport belt and a calibrating sanding belt of the belt sanding machine; and, wherein the polishing surface comes into contact with the calibrating sanding belt; wherein the thickness of the polishing layer is reduced.

4 Claims, 9 Drawing Sheets

(56) References Cited

U.S. PATENT DOCUMENTS

| | | | | |
|---|---|---|---|---|
| 6,761,619 | B1 * | 7/2004 | Held | 451/41 |
| 6,800,020 | B1 * | 10/2004 | Boyd et al. | 451/56 |
| 6,843,709 | B1 * | 1/2005 | Crkvenac et al. | 451/41 |
| 6,852,020 | B2 * | 2/2005 | Petroski et al. | 451/526 |
| 6,931,330 | B1 * | 8/2005 | Yi et al. | 702/41 |
| 6,935,938 | B1 * | 8/2005 | Gotkis et al. | 451/443 |
| 6,955,587 | B2 * | 10/2005 | Muldowney | 451/41 |
| 7,029,369 | B2 * | 4/2006 | Mikhaylich et al. | 451/7 |
| 7,097,544 | B1 * | 8/2006 | Tolles et al. | 451/66 |
| 7,118,461 | B2 * | 10/2006 | West et al. | 451/56 |
| 7,255,632 | B2 * | 8/2007 | Tolles et al. | 451/41 |
| 7,563,157 | B2 * | 7/2009 | Kramer | 451/443 |
| 8,272,922 | B2 * | 9/2012 | Duong | 451/41 |
| 8,408,965 | B2 * | 4/2013 | Bennett et al. | 451/5 |
| 2002/0146966 | A1 * | 10/2002 | Renteln | 451/41 |
| 2004/0116054 | A1 * | 6/2004 | Geyer | 451/285 |
| 2005/0239380 | A1 * | 10/2005 | Hosaka et al. | 451/41 |
| 2012/0083187 | A1 * | 4/2012 | Okamoto et al. | 451/28 |
| 2012/0118758 | A1 * | 5/2012 | Ellis et al. | 205/687 |
| 2014/0030961 | A1 * | 1/2014 | Nunley et al. | 451/56 |

OTHER PUBLICATIONS

Drum Sanding Thin Stock Forum 2005 http://www.ncwoodworker.net/forums/showthread.php?t=36993.*

Radial Clearance of a Bearing 2012 http://bearingsindustry.com/aboutbearing/radial.htm.*

* cited by examiner

METHOD FOR CHEMICAL MECHANICAL POLISHING LAYER PRETEXTURING

The present invention relates generally to the field of chemical mechanical polishing. In particular, the present invention is directed to a method for chemical mechanical polishing layer pretexturing.

In the fabrication of integrated circuits and other electronic devices, multiple layers of conducting; semiconducting and dielectric materials are deposited onto and removed from a surface of a semiconductor wafer. Thin layers of conducting, semiconducting and dielectric materials may be deposited using a number of deposition techniques. Common deposition techniques in modern wafer processing include physical vapor deposition (PVD), also known as sputtering, chemical vapor deposition (CVD), plasma-enhanced chemical vapor deposition (PECVD) and electrochemical plating, among others. Common removal techniques include wet and dry isotropic and anisotropic etching, among others.

As layers of materials are sequentially deposited and removed, the uppermost surface of the wafer becomes non-planar. Because subsequent semiconductor processing (e.g., metallization) requires the wafer to have a flat surface, the wafer needs to be planarized. Planarization is useful for removing undesired surface topography and surface defects, such as rough surfaces, agglomerated materials, crystal lattice damage, scratches and contaminated layers or materials.

Chemical mechanical planarization, or chemical mechanical polishing (CMP), is a common technique used to planarize or polish workpieces such as semiconductor wafers. In conventional CMP, a wafer carrier, or polishing head, is mounted on a carrier assembly. The polishing head holds the wafer and positions the wafer in contact with a polishing layer of a polishing pad that is mounted on a table or platen within a CMP apparatus. The carrier assembly provides a controllable pressure between the wafer and polishing pad. Simultaneously, a polishing medium is dispensed onto the polishing pad and is drawn into the gap between the wafer and polishing layer. To effect polishing, the polishing pad and wafer typically rotate relative to one another. As the polishing pad rotates beneath the wafer, the wafer sweeps out a typically annular shaped polishing track, or polishing region, wherein the wafer's surface directly confronts the polishing layer. The wafer surface is polished and made planar by chemical and mechanical action of the polishing layer and polishing medium on the surface.

A factor that affects the magnitude and stability of the chemical mechanical polishing rates achieved with a given polishing layer involves pad conditioning (i.e., a technique used for bringing the polishing layer's polishing surface into the proper form for polishing). Specifically, the polishing surface of conventional chemical mechanical polishing layers are typically conditioned to provide the desired texture for effective polishing of a given substrate. This process is frequently referred to in the art as break-in conditioning.

Break in conditioning is frequently performed using the same polishing equipment subsequently used for actual substrate polishing. Conventional break in conditioning techniques frequently utilize dummy or blanket wafers. The break in conditioning typically comprises polishing dummy or blank wafers having a silicon oxide surface. After removal of a few microns of the silicon dioxide surface on the dummy or blank wafers, the polishing surface of the polishing pad is sufficiently preconditioned for actual polishing. This break in conditioning process is extremely time consuming, requiring 30 minutes or more to complete, and it is extremely expensive in consuming numerous wafers, e.g., about ten wafers per pad.

Accordingly, it would be desirable to provide manufactured chemical mechanical polishing layers in which the polishing surface has been processed to provide an enhanced surface texture prior to deliver to the customer for use in chemical mechanical polishing such that the need for break in conditioning can be minimized.

One approach to preparing the polishing surface of a chemical mechanical polishing layer for the polishing of a substrate is disclosed by Hosaka et al. in U.S. Patent Application Publication No. 2005/0239380. Hosaka et al. teach that the polishing surface of a chemical mechanical polishing layer can be conditioned by abrading the polishing surface by sanding on a wide belt sander.

Notwithstanding, there is a continuing need for improved methods for pretexturing the polishing surface of a chemical mechanical polishing layer.

The present invention provides a method for pretexturing the polishing surface of a chemical mechanical polishing layer, comprising: providing a chemical mechanical polishing layer (10) having a polishing surface (14) and an initial average thickness, $T_{IA}$; providing a belt sanding machine (20), comprising: a chemical mechanical polishing layer transport module (30), comprising: a transport belt (32); a transport feed roller (34); at least two transport feed roller bearings (36); at least one transport support roller; and, a transport belt driver; wherein the transport feed roller bearings (36) facilitate the rotational movement of the transport feed roller about a transport feed roller axis of rotation, $A_{tfr}$; wherein the transport belt (32) is trained around the transport feed roller (34) and the at least one transport support roller; and, wherein the transport belt driver is in mechanical communication with the transport belt (32) to facilitate movement of the transport belt (32); and, a calibrating sanding module (40), comprising: a calibrating sanding belt (42); a non-drive roller (44); at least two non-drive roller bearings (45); a drive roller (46); at least two drive roller bearings (47,48), wherein the drive roller bearings (47,48) have a radial clearance (60, 66); a calibrating sanding belt driver (50), wherein the calibrating sanding belt driver (50) is in mechanical communication with the drive roller (46) to facilitate movement of the calibrating sanding belt (42); wherein the calibrating sanding belt (42) is trained around the non-drive roller (44) and the drive roller (46); wherein the at least two non-drive roller bearings (45) facilitate the rotational movement of the non-drive roller (44) about a non-drive roller axis of rotation, $A_{ndr}$; and, wherein the at least two drive roller bearings (47) facilitate the rotational movement of the drive roller (46) about a drive roller axis of rotation, $A_{dr}$; wherein the drive roller axis of rotation, $A_{dr}$, is substantially parallel to the transport feed roller axis of rotation, $A_{tfr}$; placing the chemical mechanical polishing layer on the transport belt; feeding the chemical mechanical polishing layer through a gap (49) between the transport belt (32) and the calibrating sanding belt (42); wherein the polishing surface (14) comes into contact with the calibrating sanding belt (42); wherein the at least two drive roller bearings (47,48) are biased such that their radial clearance (60,66) is disposed on the same side of the drive roller (46) relative to the chemical mechanical polishing layer (10) as the chemical mechanical polishing layer (10) passes through the gap (49); wherein the gap (49) is less than the initial average thickness, $T_{IA}$, of the chemical mechanical polishing layer (10); wherein the chemical mechanical polishing layer (10) exhibits a final average thickness, $T_{FA}$, after passing through the gap (49); and, wherein the final average thickness, $T_{FA}$, is less than the initial average thickness, $T_{IA}$.

The present invention provides a method for pretexturing the polishing surface of a chemical mechanical polishing layer, comprising: providing a chemical mechanical polishing layer (10) having a polishing surface (14) and an initial average thickness, $T_{IA}$; providing a belt sanding machine (20), comprising: a chemical mechanical polishing layer transport module (30), comprising: a transport belt (32); a transport feed roller (34); at least two transport feed roller bearings (36); at least one transport support roller; and, a transport belt driver; wherein the transport feed roller bearings (36) facilitate the rotational movement of the transport feed roller about a transport feed roller axis of rotation, $A_{tfr}$; wherein the transport belt (32) is trained around the transport feed roller (34) and the at least one transport support roller; and, wherein the transport belt driver is in mechanical communication with the transport belt (32) to facilitate movement of the transport belt (32); and, a calibrating sanding module (40), comprising: a calibrating sanding belt (42); a non-drive roller (44); at least two non-drive roller bearings (45); a drive roller (46); at least two drive roller bearings (47,48), wherein the drive roller bearings (47,48) have a radial clearance (60, 66); a drive roller biaser (68); and, a calibrating sanding belt driver (50), wherein the calibrating sanding belt driver (50) is in mechanical communication with the drive roller (46) to facilitate movement of the calibrating sanding belt (42); wherein the calibrating sanding belt (42) is trained around the non-drive roller (44) and the drive roller (46); wherein the at least two non-drive roller bearings (45) facilitate the rotational movement of the non-drive roller (44) about a non-drive roller axis of rotation, $A_{ndr}$; and, wherein the at least two drive roller bearings (47) facilitate the rotational movement of the drive roller (46) about a drive roller axis of rotation, $A_{dr}$; wherein the drive roller axis of rotation, $A_{dr}$, is substantially parallel to the transport feed roller axis of rotation, $A_{tfr}$; placing the chemical mechanical polishing layer on the transport belt; feeding the chemical mechanical polishing layer through a gap (49) between the transport belt (32) and the calibrating sanding belt (42); wherein the polishing surface (14) comes into contact with the calibrating sanding belt (42); wherein the drive roller biaser (68) engages the drive roller (46) such that the radial clearance (60,66) for the at least two drive roller bearings (47,48) is disposed on the same side of the drive roller (46) relative to the chemical mechanical polishing layer (10) as the chemical mechanical polishing layer (10) passes through the gap (49); wherein the gap (49) is less than the initial average thickness, $T_{IA}$, of the chemical mechanical polishing layer (10); wherein the chemical mechanical polishing layer (10) exhibits a final average thickness, $T_{FA}$, after passing through the gap (49); and, wherein the final average thickness, $T_{FA}$, is less than the initial average thickness, $T_{IA}$.

The present invention provides a method for pretexturing the polishing surface of a chemical mechanical polishing layer, comprising: providing a chemical mechanical polishing layer (10) having a polishing surface (14) and an initial average thickness, $T_{IA}$; providing a belt sanding machine (20), comprising: a chemical mechanical polishing layer transport module (30), comprising: a transport belt (32); a transport feed roller (34); at least two transport feed roller bearings (36); at least one transport support roller; and, a transport belt driver; wherein the transport feed roller bearings (36) facilitate the rotational movement of the transport feed roller about a transport feed roller axis of rotation, $A_{tfr}$; wherein the transport belt (32) is trained around the transport feed roller (34) and the at least one transport support roller; and, wherein the transport belt driver is in mechanical communication with the transport belt (32) to facilitate movement of the transport belt (32); and, a calibrating sanding module (40), comprising: a calibrating sanding belt (42); a non-drive roller (44); at least two non-drive roller bearings (45); a drive roller (46); at least two drive roller bearings (47,48), wherein the drive roller bearings (47,48) have a radial clearance (60, 66); a drive roller biaser (68); a drive roller biasing bearing (70) mounted on and coaxial with the drive roller (46); and, a calibrating sanding belt driver (50), wherein the calibrating sanding belt driver (50) is in mechanical communication with the drive roller (46) to facilitate movement of the calibrating sanding belt (42); wherein the calibrating sanding belt (42) is trained around the non-drive roller (44) and the drive roller (46); wherein the at least two non-drive roller bearings (45) facilitate the rotational movement of the non-drive roller (44) about a non-drive roller axis of rotation, $A_{ndr}$; and, wherein the at least two drive roller bearings (47) facilitate the rotational movement of the drive roller (46) about a drive roller axis of rotation, $A_{dr}$; wherein the drive roller axis of rotation, $A_{dr}$, is substantially parallel to the transport feed roller axis of rotation, $A_{tfr}$; placing the chemical mechanical polishing layer on the transport belt; feeding the chemical mechanical polishing layer through a gap (49) between the transport belt (32) and the calibrating sanding belt (42); wherein the polishing surface (14) comes into contact with the calibrating sanding belt (42); wherein the drive roller biaser (68) engages the drive roller (46) by exerting pressure against drive roller biasing bearing (70) such that the radial clearance (60,66) for the at least two drive roller bearings (47,48) is disposed on the same side of the drive roller (46) relative to the chemical mechanical polishing layer (10) as the chemical mechanical polishing layer (10) passes through the gap (49); wherein the gap (49) is less than the initial average thickness, $T_{IA}$, of the chemical mechanical polishing layer (10); wherein the chemical mechanical polishing layer (10) exhibits a final average thickness, $T_{FA}$, after passing through the gap (49); and, wherein the final average thickness, $T_{FA}$, is less than the initial average thickness, $T_{IA}$.

The present invention also provides a method for pretexturing the polishing surface of a chemical mechanical polishing layer, comprising: providing a chemical mechanical polishing layer (10) having a polishing surface (14) and an initial average thickness, $T_{IA}$; providing a belt sanding machine (20), comprising: a chemical mechanical polishing layer transport module (30), comprising: a transport belt (32); a transport feed roller (34); at least two transport feed roller bearings (36); at least one transport support roller; and, a transport belt driver; wherein the transport feed roller bearings (36) facilitate the rotational movement of the transport feed roller about a transport feed roller axis of rotation, $A_{tfr}$; wherein the transport belt (32) is trained around the transport feed roller (34) and the at least one transport support roller; and, wherein the transport belt driver is in mechanical communication with the transport belt (32) to facilitate movement of the transport belt (32); and, a calibrating sanding module (40), comprising: a calibrating sanding belt (42); a non-drive roller (44); at least two non-drive roller bearings (45); a drive roller (46); at least two drive roller bearings (47,48), wherein the drive roller bearings (47,48) have a radial clearance (60, 66); a calibrating sanding belt driver (50), wherein the calibrating sanding belt driver (50) is in mechanical communication with the drive roller (46) to facilitate movement of the calibrating sanding belt (42); wherein the calibrating sanding belt (42) is trained around the non-drive roller (44) and the drive roller (46); wherein the at least two non-drive roller bearings (45) facilitate the rotational movement of the non-drive roller (44) about a non-drive roller axis of rotation, $A_{ndr}$; and, wherein the at least two drive roller bearings (47) facilitate the rotational movement of the drive roller (46) about a drive roller axis of rotation, $A_{dr}$; wherein the drive roller axis of rotation, $A_{dr}$, is substantially parallel to the transport feed roller axis of rotation, $A_{tfr}$; providing a carrier having an average thickness, $T_{CA}$; and, placing the chemical mechanical polishing layer on the carrier; placing the chemical mechanical polishing layer on the carrier on the transport belt; feeding the chemical mechanical polishing layer on the carrier through a gap (49) between the transport belt (32) and the calibrating sanding belt (42); wherein the polishing surface (14) comes into contact with the calibrating sanding belt (42); wherein the at least two drive roller bearings (47,48) are biased such that their radial clearance (60,66) is disposed on the same side of the drive roller (46) relative to the chemical mechanical polishing layer (10) as the chemical mechanical polishing layer (10) passes through the gap (49); wherein the gap (49) is smaller than the sum of the average thickness, $T_{CA}$, of the carrier and the initial average thickness, $T_{IA}$, of the chemical mechanical polishing layer (10); wherein the chemical mechanical polishing layer (10) exhibits a final average thickness, $T_{FA}$, after passing through the gap (49); and, wherein the final average thickness, $T_{FA}$, is less than the initial average thickness, $T_{IA}$.

The present invention also provides a method for pretexturing the polishing surface of a chemical mechanical polishing layer, comprising: providing a chemical mechanical polishing layer (10) having a polishing surface (14) and an initial average thickness, $T_{IA}$; providing a belt sanding machine (20), comprising: a chemical mechanical polishing layer transport module (30), comprising: a transport belt (32); a transport feed roller (34); at least two transport feed roller bearings (36); at least one transport support roller; and, a transport belt driver; wherein the transport feed roller bearings (36) facilitate the rotational movement of the transport feed roller about a transport feed roller axis of rotation, $A_{tfr}$; wherein the transport belt (32) is trained around the transport feed roller (34) and the at least one transport support roller; and, wherein the transport belt driver is in mechanical communication with the transport belt (32) to facilitate movement of the transport belt (32); and, a calibrating sanding module (40), comprising: a calibrating sanding belt (42); a non-drive roller (44); at least two non-drive roller bearings (45); a drive roller (46); at least two drive roller bearings (47,48), wherein the drive roller bearings (47,48) have a radial clearance (60, 66); a drive roller biaser (68); and, a calibrating sanding belt driver (50), wherein the calibrating sanding belt driver (50) is in mechanical communication with the drive roller (46) to facilitate movement of the calibrating sanding belt (42); wherein the calibrating sanding belt (42) is trained around the non-drive roller (44) and the drive roller (46); wherein the at least two non-drive roller bearings (45) facilitate the rotational movement of the non-drive roller (44) about a non-drive roller axis of rotation, $A_{ndr}$; and, wherein the at least two drive roller bearings (47) facilitate the rotational movement of the drive roller (46) about a drive roller axis of rotation, $A_{dr}$; wherein the drive roller axis of rotation, $A_{dr}$, is substantially parallel to the transport feed roller axis of rotation, $A_{tfr}$; providing a carrier having an average thickness, $T_{CA}$; and, placing the chemical mechanical polishing layer on the carrier; placing the chemical mechanical polishing layer on the carrier on the transport belt; feeding the chemical mechanical polishing layer on the carrier through a gap (49) between the transport belt (32) and the calibrating sanding belt (42); wherein the polishing surface (14) comes into contact with the calibrating sanding belt (42); wherein the drive roller biaser (68) engages the drive roller (46) such that the radial clearance (60,66) for the at least two drive roller bearings (47,48) is disposed on the same side of the drive roller (46) relative to the chemical mechanical polishing layer (10) as the chemical mechanical polishing layer (10) passes through the gap (49); wherein the gap (49) is smaller than the sum of the average thickness, $T_{CA}$, of the carrier and the initial average thickness, $T_{IA}$, of the chemical mechanical polishing layer (10); wherein the chemical mechanical polishing layer (10) exhibits a final average thickness, $T_{FA}$, after passing through the gap (49); and, wherein the final average thickness, $T_{FA}$, is less than the initial average thickness, $T_{IA}$.

The present invention also provides a method for pretexturing the polishing surface of a chemical mechanical polishing layer, comprising: providing a chemical mechanical polishing layer (10) having a polishing surface (14) and an initial average thickness, $T_{IA}$; providing a belt sanding machine (20), comprising: a chemical mechanical polishing layer transport module (30), comprising: a transport belt (32); a transport feed roller (34); at least two transport feed roller bearings (36); at least one transport support roller; and, a transport belt driver; wherein the transport feed roller bearings (36) facilitate the rotational movement of the transport feed roller about a transport feed roller axis of rotation, $A_{tfr}$; wherein the transport belt (32) is trained around the transport feed roller (34) and the at least one transport support roller; and, wherein the transport belt driver is in mechanical communication with the transport belt (32) to facilitate movement of the transport belt (32); and, a calibrating sanding module (40), comprising: a calibrating sanding belt (42); a non-drive roller (44); at least two non-drive roller bearings (45); a drive roller (46); at least two drive roller bearings (47,48), wherein the drive roller bearings (47,48) have a radial clearance (60, 66); a drive roller biaser (68); a drive roller biasing bearing (70) mounted on and coaxial with the drive roller (46); and, a calibrating sanding belt driver (50), wherein the calibrating sanding belt driver (50) is in mechanical communication with the drive roller (46) to facilitate movement of the calibrating sanding belt (42); wherein the calibrating sanding belt (42) is trained around the non-drive roller (44) and the drive roller (46); wherein the at least two non-drive roller bearings (45) facilitate the rotational movement of the non-drive roller (44) about a non-drive roller axis of rotation, $A_{ndr}$; and, wherein the at least two drive roller bearings (47) facilitate the rotational movement of the drive roller (46) about a drive roller axis of rotation, $A_{dr}$; wherein the drive roller axis of rotation, $A_{dr}$, is substantially parallel to the transport feed roller axis of rotation, $A_{tfr}$; providing a carrier having an average thickness, $T_{CA}$; and, placing the chemical mechanical polishing layer on the carrier; placing the chemical mechanical polishing layer on the carrier on the transport belt; feeding the chemical mechanical polishing layer on the carrier through a gap (49) between the transport belt (32) and the calibrating sanding belt (42); wherein the polishing surface (14) comes into contact with the calibrating sanding belt (42); wherein the drive roller biaser (68) engages the drive roller (46) by exerting pressure against drive roller biasing bearing (70) such that the radial clearance (60,66) for the at least two drive roller bearings (47,48) is disposed on the same side of the drive roller (46) relative to the chemical mechanical polishing layer (10) as the chemical mechanical polishing layer (10) passes through the gap (49); wherein the gap (49) is smaller than the sum of the average thickness, $T_{CA}$, of the carrier and the initial average thickness, $T_{IA}$, of the chemical mechanical polishing layer (10); wherein the chemical mechanical polishing layer (10) exhibits a final average thickness, $T_{FA}$, after passing through the gap (49); and, wherein the final average thickness, $T_{FA}$, is less than the initial average thickness, $T_{IA}$.

DETAILED DESCRIPTION

Figure 5:
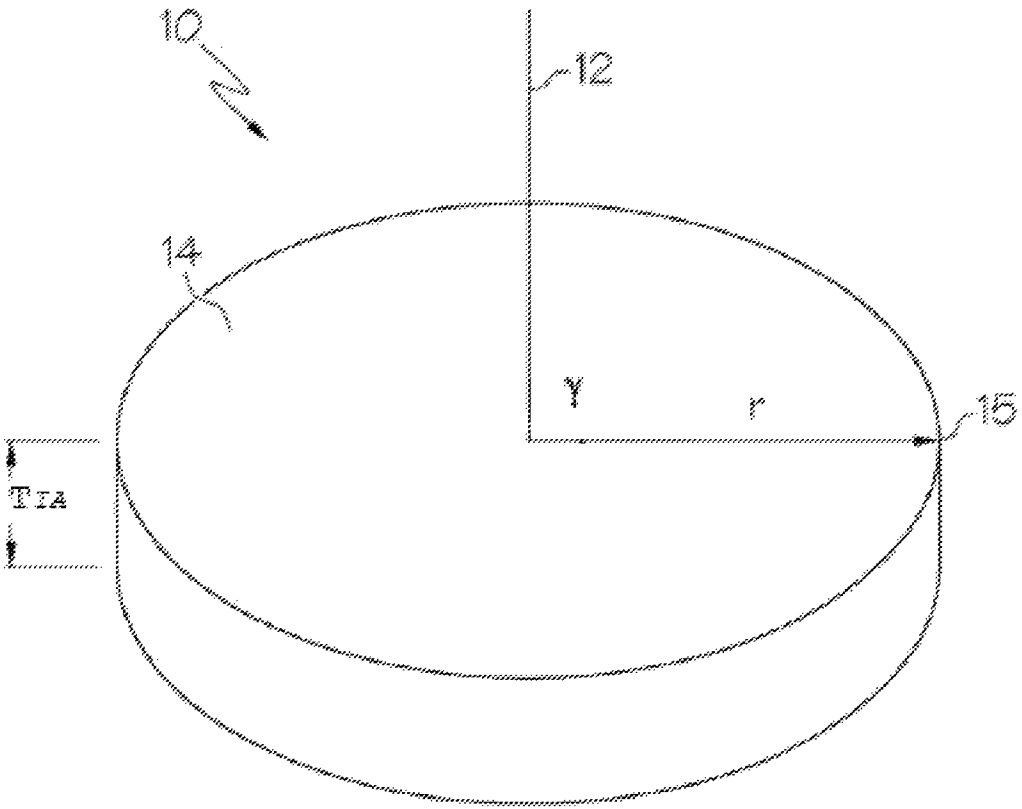
FIG. 5 is a perspective top/side view of a chemical mechanical polishing layer.

The term "substantially circular cross section" as used herein and in the appended claims in reference to a chemical mechanical polishing pad or a polishing pad component (e.g., polishing layer 10) means that the longest radius, r, of a cross section from a central axis 12 to an outer periphery 15 of the polishing pad component is ≤20% longer than the shortest radius, r, of the cross section from the central axis 12 to the outer periphery 15. (See FIG. 5).

The term "substantially parallel" as used herein and in the appended claims in reference to the drive roller axis of rotation, $A_{dr}$, and the transport feed roller axis of rotation, $A_{tfr}$, means that the drive roller axis of rotation, $A_{dr}$, and the transport feed roller axis of rotation, $A_{tfr}$, are sufficiently parallel such that the gap formed between the transport belt and the calibrating sanding belt varies by less than 0.05 mm (preferably ≤0.045 mm) across the width of the gap, W.

There are a wide variety of polymer formulations used in the manufacture of chemical mechanical polishing layers having a polishing surface, wherein the polishing surface is adapted for polishing a substrate (preferably, wherein the substrate is selected from at least one of a magnetic substrate, an optical substrate and a semiconductor substrate; more preferably, wherein the substrate is a semiconductor substrate; most preferably, wherein the substrate is a semiconductor wafer). One of ordinary skill in the art will know to select an appropriate polymer formulation for a given chemical mechanical polishing layer application.

Figure 1:
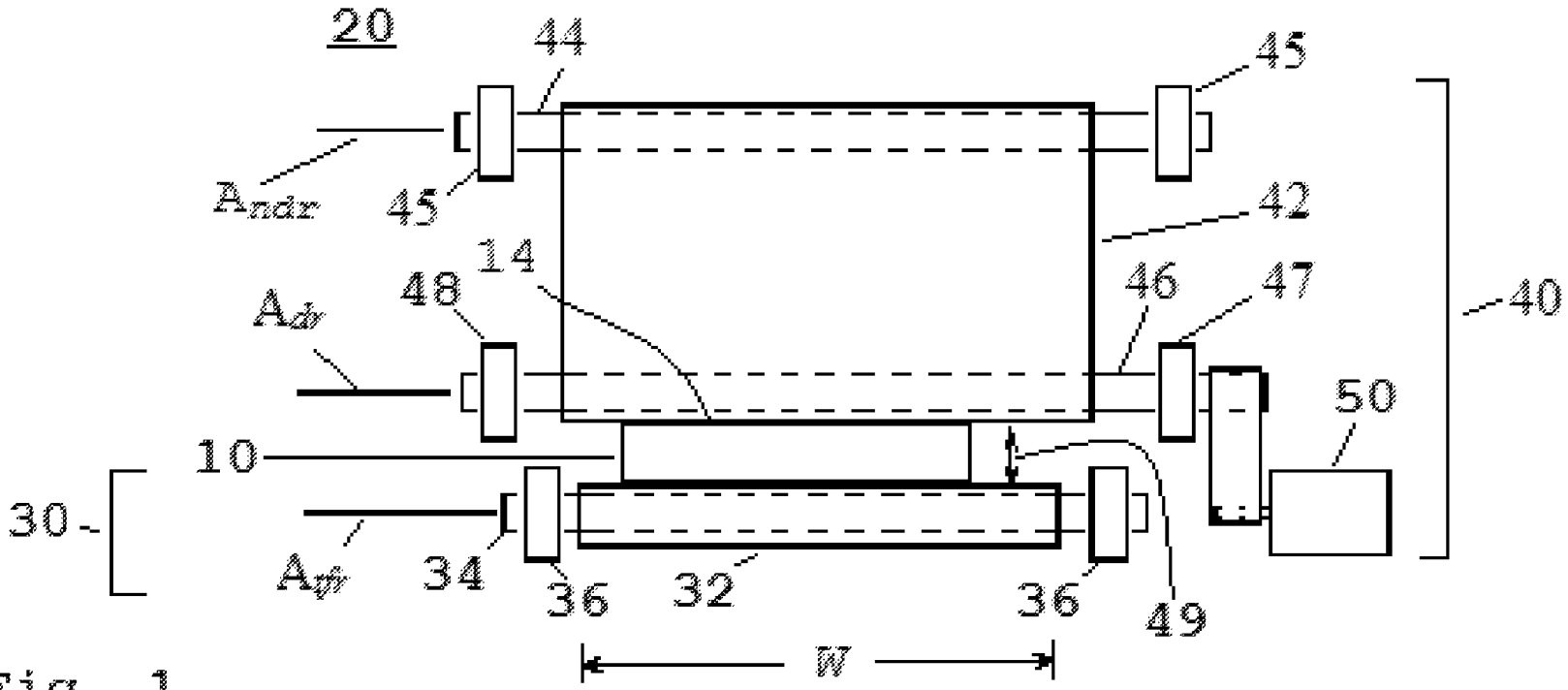
FIG. 1 is a depiction of a belt sanding machine used in the method of the present invention.

With reference to FIG. 1, the method for pretexturing the polishing surface of a chemical mechanical polishing layer of the present invention preferably comprises: providing a chemical mechanical polishing layer (10) having a polishing surface (14) and an initial average thickness, $T_{IA}$; providing a belt sanding machine (20), comprising: a chemical mechanical polishing layer transport module (30), comprising: a transport belt (32); a transport feed roller (34); at least two transport feed roller bearings (36); at least one transport support roller (not shown); and, a transport belt driver (not shown); wherein the transport feed roller bearings (36) facilitate the rotational movement of the transport feed roller about a transport feed roller axis of rotation, $A_{tfr}$; wherein the transport belt (32) is trained around the transport feed roller (34) and the at least one transport support roller (not shown); and, wherein the transport belt driver (not shown) is in mechanical communication with the transport belt (32) to facilitate movement of the transport belt (32); and, a calibrating sanding module (40), comprising: a calibrating sanding belt (42); a non-drive roller (44); at least two non-drive roller bearings (45); a drive roller (46); at least two drive roller bearings (47,48) (preferably, wherein the drive roller bearings are selected from radial ball bearings and radial bushings; more preferably, wherein the drive roller bearings are radial ball bearings), wherein the drive roller bearings (47,48) have a radial clearance (60,66); a calibrating sanding belt driver (50), wherein the calibrating sanding belt driver (50) is in mechanical communication with the drive roller (46) to facilitate movement of the calibrating sanding belt (42); wherein the calibrating sanding belt (42) is trained around the non-drive roller (44) and the drive roller (46); wherein the at least two non-drive roller bearings (45) facilitate the rotational movement of the non-drive roller (44) about a non-drive roller axis of rotation, $A_{ndr}$; and, wherein the at least two drive roller bearings (47) facilitate the rotational movement of the drive roller (46) about a drive roller axis of rotation, $A_{dr}$; wherein the drive roller axis of rotation, $A_{ch}$, is substantially parallel to the transport feed roller axis of rotation, $A_{tfr}$; placing the chemical mechanical polishing layer on the transport belt; feeding the chemical mechanical polishing layer through a gap (49) between the transport belt (32) and the calibrating sanding belt (42); wherein the polishing surface (14) comes into contact with the calibrating sanding belt (42); wherein the at least two drive roller bearings (47,48) are biased such that their radial clearance (60,66) (wherein radial clearance is defined as the total clearance between the rolling elements (52,58) and the inner race (54,64) and the outer race (56,62)) is disposed on the same side of the drive roller (46) relative to the chemical mechanical polishing layer (10) as the chemical mechanical polishing layer (10) passes through the gap (49); wherein the gap (49) is less than the initial average thickness, $T_{IA}$, of the chemical mechanical polishing layer (10); wherein the chemical mechanical polishing layer (10) exhibits a final average thickness, $T_{FA}$, after passing through the gap (49); and, wherein the final average thickness, $T_{FA}$, is less than the initial average thickness, $T_{IA}$. Preferably, the drive roller bearings are radial ball bearings.

Figure 3:
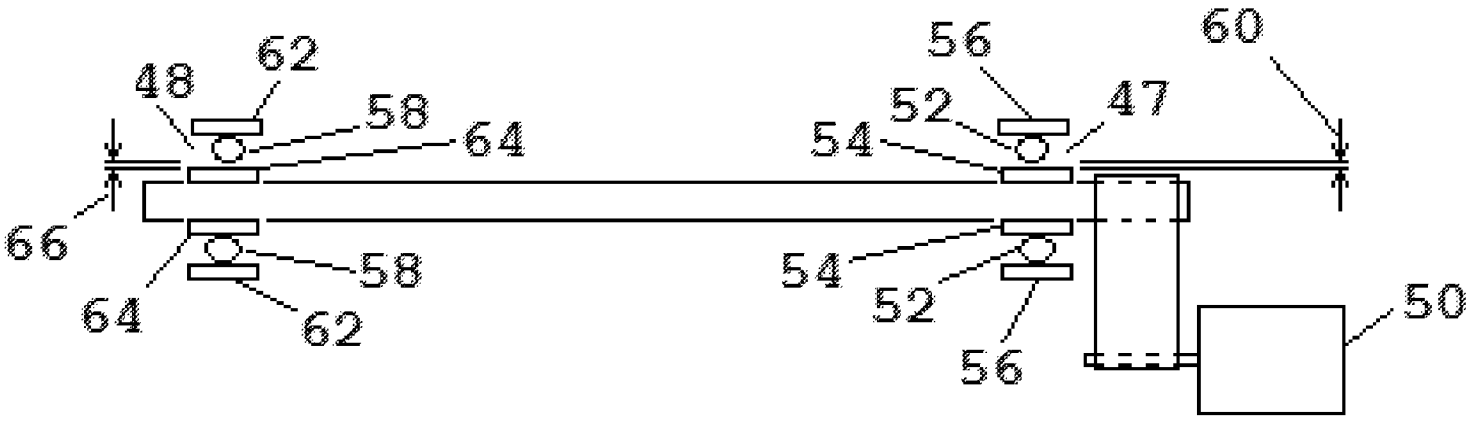
FIG. 3 is a depiction of a drive roller assembly for a belt sanding machine used in the method of the present invention.

With reference to FIGS. 1 and 3, the method for pretexturing the polishing surface of a chemical mechanical polishing layer of the present invention preferably comprises: providing a chemical mechanical polishing layer (10) having a polishing surface (14) and an initial average thickness, $T_{IA}$; providing a belt sanding machine (20), comprising: a chemical mechanical polishing layer transport module (30), comprising: a transport belt (32); a transport feed roller (34); at least two transport feed roller bearings (36); at least one transport support roller (not shown); and, a transport belt driver (not shown); wherein the transport feed roller bearings (36) facilitate the rotational movement of the transport feed roller about a transport feed roller axis of rotation, $A_{tfr}$; wherein the transport belt (32) is trained around the transport feed roller (34) and the at least one transport support roller (not shown); and, wherein the transport belt driver (not shown) is in mechanical communication with the transport belt (32) to facilitate movement of the transport belt (32); and, a calibrating sanding module (40), comprising: a calibrating sanding belt (42); a non-drive roller (44); at least two non-drive roller bearings (45); a drive roller (46); at least two drive roller bearings (47,48) (preferably, wherein the drive roller bearings are selected from radial ball bearings and radial bushings), wherein the drive roller bearings (47,48) have a radial clearance (60,66); a calibrating sanding belt driver (50), wherein the calibrating sanding belt driver (50) is in mechanical communication with the drive roller (46) to facilitate movement of the calibrating sanding belt (42); wherein the calibrating sanding belt (42) is trained around the non-drive roller (44) and the drive roller (46); wherein the at least two non-drive roller bearings (45) facilitate the rotational movement of the non-drive roller (44) about a non-drive roller axis of rotation, $A_{ndr}$; and, wherein the at least two drive roller bearings (47) facilitate the rotational movement of the drive roller (46) about a drive roller axis of rotation, $A_{dr}$; wherein the drive roller axis of rotation, $A_{dr}$ is substantially parallel to the transport feed roller axis of rotation, $A_{tfr}$; placing the chemical mechanical polishing layer on the transport belt; feeding the chemical mechanical polishing layer through a gap (49) between the transport belt (32) and the calibrating sanding belt (42); wherein the polishing surface (14) comes into contact with the calibrating sanding belt (42); wherein the at least two drive roller bearings (47,48) are biased such that their radial clearance (60,66) (wherein radial clearance is defined as the total clearance between the rolling elements (52,58) and the inner race (54,64) and the outer race (56,62)) is disposed on the same side of the drive roller (46) relative to the chemical mechanical polishing layer (10) as the chemical mechanical polishing layer (10) passes through the gap (49); wherein the gap (49) is less than the initial average thickness, $T_{IA}$, of the chemical mechanical polishing layer (10); wherein the chemical mechanical polishing layer (10) exhibits a final average thickness, $T_{FA}$, after passing through the gap (49); and, wherein the final average thickness, $T_{FA}$, is less than the initial average thickness, $T_{IA}$.

Preferably, in the method of the present invention, the at least two drive roller bearings (47,48) are biased such that their radial clearance (60,66) (wherein radial clearance is defined as the total clearance between the rolling elements (52,58) and the inner race (54,64) and the outer race (56,62)) is disposed on the same side of the drive roller (46) relative to the chemical mechanical polishing layer (10) as the chemical mechanical polishing layer (10) passes through the gap (49). (See FIGS. 1 and 3). More preferable, the radial clearances (60,66) are disposed on the side of the drive roller (46) opposite the side of the drive roller that is closest to the chemical mechanical polishing layer as it passes through the gap.

Figure 4:
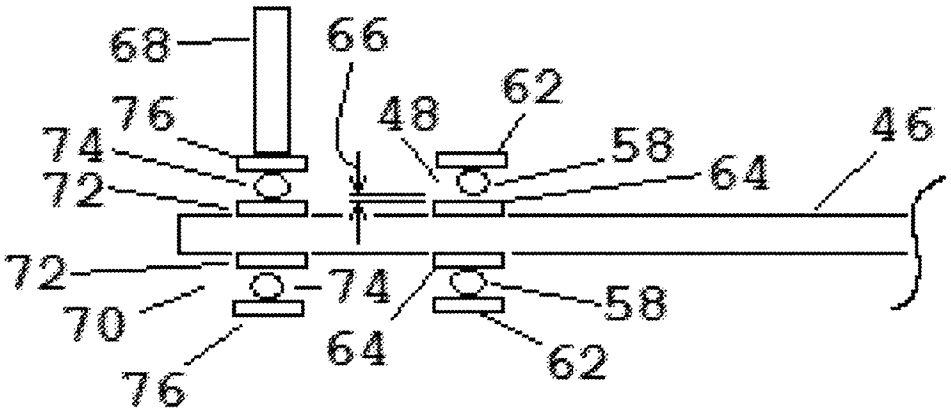
FIG. 4 is a depiction of a portion of a drive roller assembly outfitted with a drive roller biaser and a drive roller biasing bearing.

Preferably, the calibrating sanding module used in the method of the present invention further comprises a driver roller bearing biaser (68). (See FIG. 4). More preferably, the outer race (62) of the drive roller bearing (48) is secured to a support member (not shown) and a drive roller bearing biaser (68) is secured to the support member (not shown), wherein the driver roller bearing biaser (68) engages and presses against the drive roller (46) such that the radial clearance (60,66) for the at least two drive roller bearings (47,48) is disposed on the same side of the drive roller relative to the chemical mechanical polishing layer (10) as it passes through the gap (49). Most preferably, the calibrating sanding module used further comprises a drive roller biasing bearing (70) mounted on and coaxial with the drive roller (46); wherein the drive roller biaser (68) engages the drive roller (46) by exerting pressure against drive roller biasing bearing (70). Preferably, the drive roller biasing bearing (70) comprises an inner race (72), a plurality of rolling elements (74) and an outer race (76); wherein the rolling elements are caged between the inner race (72) and the outer race (76); wherein the inner race (72) is press fit onto the drive roller (46) and wherein the drive roller biaser presses against the outer race (76) in a direction perpendicular to both the drive roller axis of rotation, $A_{dr}$, and the transport feed roller axis of rotation, $A_{tfr}$. Preferably, the driver roller biasing bearing (70) is a radial ball bearing.

Preferably, in the method of the present invention, the belt sanding machine (20) provided, comprises: a calibrating sanding module (40), wherein the calibrating sanding module is selected from the group consisting of a forward calibrating sanding module and a reverse calibrating sanding module. The calibrating sanding belt in a forward calibrating sanding module rotates in the direction of the travel of the chemical mechanical polishing layer as it passes through the belt sanding machine. The calibrating sanding belt in a reverse calibrating sanding module rotates in the opposite direction of the travel of the chemical mechanical polishing layer as it passes through the belt sanding machine. More preferably, in the method of the present invention, the belt sanding machine (20) provided, comprises: a calibrating sanding module (40), wherein the calibrating sanding module is a forward calibrating sanding module.

Figure 6:
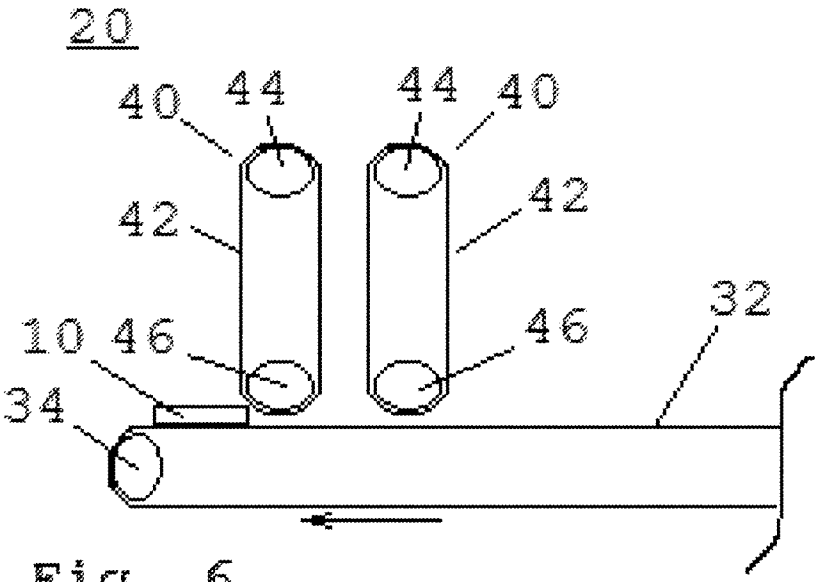
FIG. 6 is a depiction of a side elevation view of a portion of a belt sanding machine.

Preferably, in the method of the present invention, the belt sanding machine (20) provided, comprises: at least two calibrating sanding modules (40) operated in series. (See FIG. 6). When the belt sanding machine (20) provided comprises two or more calibrating sanding modules (40), the calibrating sanding belts (42) used in the two or more calibrating sanding modules (40) can be the same or different. Preferably, the calibrating sanding belts (42) used in the different calibrating sanding modules (40) are different. Preferably, the grit size used on the abrasive surface of the calibrating sanding belts (42) employed in the different calibrating sanding modules (40) is different. When the belt sanding machine (20) provided comprises two or more calibrating sanding modules (40), each calibrating sanding module is preferably independently selected from a forward calibrating sanding module and a reverse calibrating sanding module. Preferably, the belt sanding machine (20) provided comprises two calibrating sanding modules (40). More preferably, the belt sanding machine (20) provided comprises two calibrating sanding modules (40), wherein both calibrating sanding modules are forward calibrating sanding modules.

Figure 7:
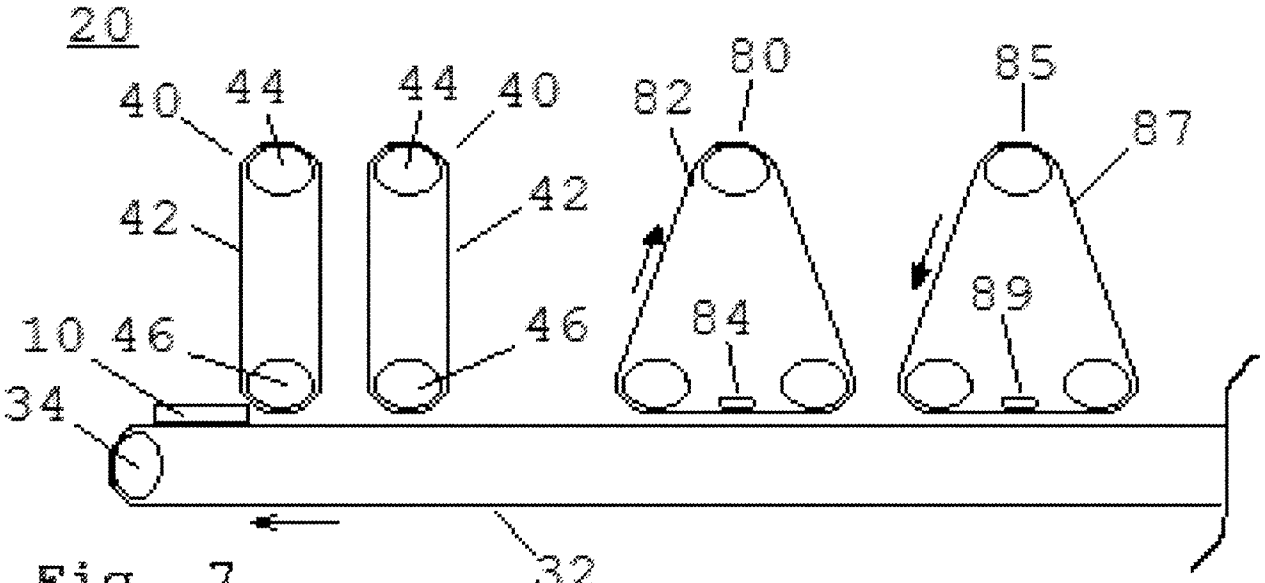
FIG. 7 is a depiction of a side elevation view of a portion of a belt sanding machine.
Figure 8:
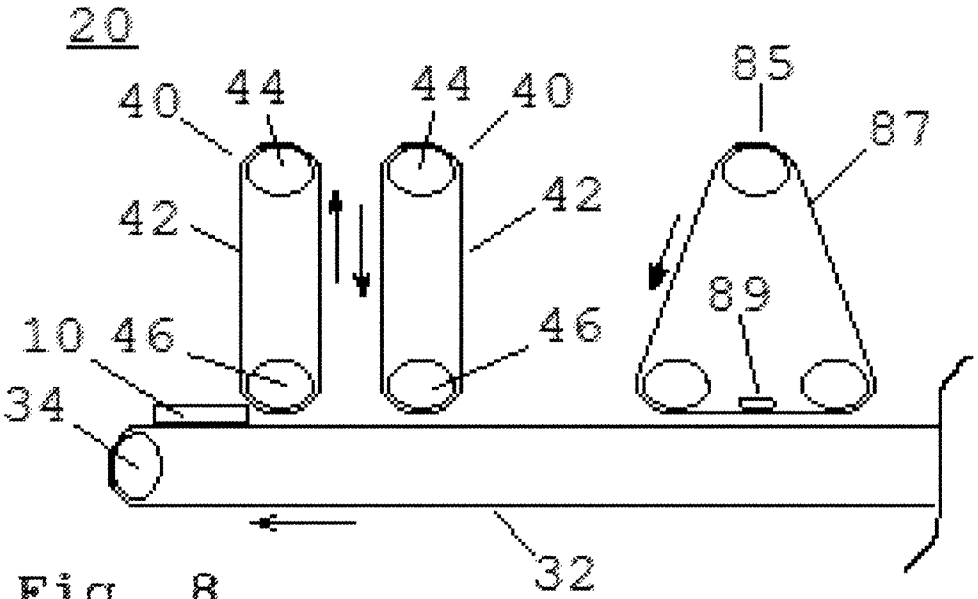
FIG. 8 is a depiction of a side elevation view of a portion of a belt sanding machine.
Figure 9:
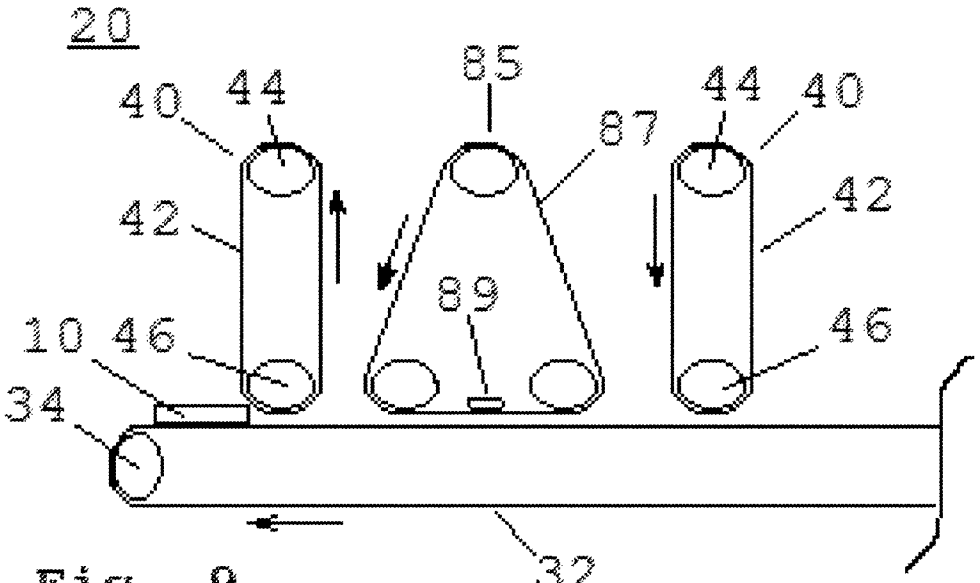
FIG. 9 is a depiction of a side elevation view of a portion of a belt sanding machine.

Preferably, in the method of the present invention, the belt sanding machine (20) provided, further comprises: at least one of a cross sanding module (80) and a longitudinal sanding module (85); wherein the cross sanding module (80) comprises a cross sanding belt (82) and a cross sanding pressure beam (84); and, wherein the longitudinal sanding module (85) comprises a longitudinal sanding belt (87) and a longitudinal sanding pressure beam (89). (See FIGS. 7-9). The cross sanding belt (82) in the cross sanding module (80) rotates in the opposite direction of the travel of the chemical mechanical polishing layer as it passes through the belt sanding machine. The longitudinal sanding belt (87) in the longitudinal sanding module (85) rotates in the same direction as the travel of the chemical mechanical polishing layer as it passes through the belt sanding machine. More preferably, in the method of the present invention, the belt sanding machine (20) provided, further comprises: a longitudinal sanding module (85). Most preferably, in the method of the present invention, the belt sanding machine (20) provided, comprises: two forward calibrating sanding modules (44) and a longitudinal sanding module (85). (See FIGS. 8-9).

To enhance the texture of the polishing surface of the chemical mechanical polishing layer, the polishing surface is contacted with a calibrating sanding belt according to the method of the present invention. Preferably, the polishing surface is contacted with two or more calibrating sanding belts. More preferably, the polishing surface is contacted with two calibrating sanding belts. Preferably, to further enhance the texture of the polishing surface of the chemical mechanical polishing layer, the polishing surface can be further contacted with at least one of a cross sanding belt and a longitudinal sanding belt according to the method of the present invention. More preferably, the polishing surface is further contacted with a longitudinal sanding belt. Most preferably, the polishing surface is contacted with two calibrating sanding belts and a longitudinal sanding belt.

The calibrating sanding belts used in the method of the present invention preferably have an abrasive surface (preferably, wherein the abrasive surface comprises at least one of silicon carbide and aluminum oxide abrasives). Preferably, the abrasive surface exhibits a grit size of 25 to 300 μm (more preferably 25 to 200 μm). Preferably, the calibrating sanding belt used in the method of the present invention comprises a backing material selected from the group consisting of a polymer film, fabric and paper.

The cross sanding belts used, if any, in the method of the present invention preferably have an abrasive surface (preferably, wherein the abrasive surface comprises at least one of silicon carbide and aluminum oxide abrasives). Preferably, the abrasive surface exhibits a grit size of 25 to 300 μm (more preferably 25 to 200 μm). Preferably, the calibrating sanding belt used in the method of the present invention comprises a backing material selected from the group consisting of a polymer film, fabric and paper.

The longitudinal sanding belts used, if any, in the method of the present invention preferably have an abrasive surface (preferably, wherein the abrasive surface comprises at least one of silicon carbide and aluminum oxide abrasives). Preferably, the abrasive surface exhibits a grit size of 25 to 300 μm (more preferably 25 to 200 μm). Preferably, the calibrating sanding belt used in the method of the present invention comprises a backing material selected from the group consisting of a polymer film, fabric and paper.

The cross sanding pressure beam (84), if any, and the longitudinal sanding pressure beam (89), if any, used in the method of the present invention, are preferably selected from pressure beams conventionally known in the sanding machine art. More preferably, the cross sanding pressure beam (84), if any, and the longitudinal sanding pressure beam (89), if any, used in the method of the present invention, used in the method of the present invention, are selected from pneumatic pressure beams and electromagnetic pressure beams. Most preferably, the cross sanding pressure beam (84), if any, and the longitudinal sanding pressure beam (89), if any, used in the method of the present invention, used in the method of the present invention, are selected from segmented pneumatic pressure beams and segmented electromagnetic pressure beams.

Preferably, the method of the present invention further comprises: providing a carrier (not shown) having an average thickness, $T_{CA}$; and, placing the chemical mechanical polishing layer on the carrier, wherein the chemical mechanical polishing layer is feed into the gap on the carrier, and, wherein the gap is smaller than the sum of the average thickness, $T_{CA}$, and the initial average thickness, $T_{IA}$. In practicing the invention, given the teachings provided herein, one or ordinary skill in the art would understand to select a carrier having a suitable thickness and material of construction. Preferably, the carrier used has a thickness of 2.54 to 5.1 mm. Preferably, the carrier used is constructed of a material selected from aluminum and acrylic sheet. Preferably, the carrier used has a substantially circular cross section. Preferably, the carrier used exhibits a diameter of 600 to 1,600 mm; preferably 600 to 1,200 mm.

Figure 2:
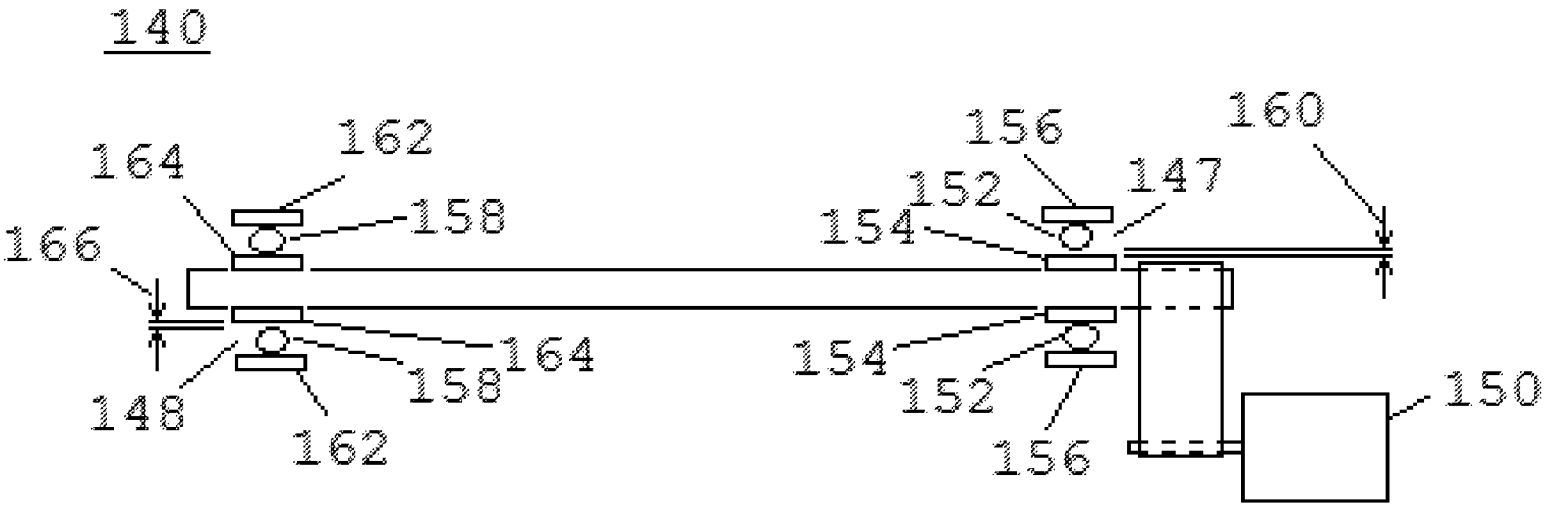
Fig. 2 (prior art)
FIG. 2 is a depiction of a typical drive roller assembly for a belt sanding machine used in prior art methods.

In stark contrast to the calibrating sanding module used in the method of the present invention, wherein the radial clearance of the drive roller bearings are disposed on the same side of the drive roller as depicted in FIGS. 1 and 3; a prior art calibrating sanding module is depicted in relevant part in FIG. 2. In particular, a calibrating sanding module (140) with a drive roller (146); drive roller bearings (147,148) having a radial clearance (160,166), wherein the radial clearance is defined as the total clearance between the rolling elements (152,158) and the inner race (154,164) and the outer race (156,162)). In the prior art calibrating sanding module, the drive roller (146) is cantilevered when it is engaged by the driver (150) such that the radial clearance (160,166) of the drive roller bearings (147,148) are disposed on opposite sides of the driver roller (146). As a result, the gap (not shown) between the transport belt (not shown) and the calibrating sanding belt (not shown) trained around the drive roller (146) is not uniform across the gap width, W (not shown). In fact, the variation in the gap across the gap width in such prior art devices tends to be at least the sum of the radial clearances (160 and 166) of the drive roller bearings (147,148). This non uniformity in the gap across the gap width causes the polishing layers being conditioned using such prior art calibrating sanding modules to exhibit an undesirable global thickness variation across the chemical mechanical polishing layer.

We claim:

1. A method for pretexturing the polishing surface of a chemical mechanical polishing layer, comprising:

providing a chemical mechanical polishing layer having a polishing surface and an initial average thickness, $T_{IA}$;

providing a belt sanding machine, comprising:

a chemical mechanical polishing layer transport module, comprising: a transport belt; a transport feed roller, at least two transport feed roller bearings; at least one transport support roller, and, a transport belt driver; wherein the transport feed roller bearings facilitate the rotational movement of the transport feed roller about a transport feed roller axis of rotation, $A_{trf}$; wherein the transport belt is trained around the transport feed roller and the at least one transport support roller; and, wherein the transport belt driver is in mechanical communication with the transport belt to facilitate movement of the transport belt; and, a calibrating sanding module, comprising: a calibrating sanding belt; a non-drive roller, at least two non-drive roller bearings; a drive roller; at least two drive roller bearings, wherein the drive roller bearings have a radial clearance; a drive roller biaser; a drive roller biasing bearing mounted on and coaxial with the drive roller, wherein the drive roller biaser engages the drive roller by exerting pressure against drive roller biasing bearing such that the radial clearance for the at least two drive roller bearings is disposed on the same side of the drive roller relative to the chemical mechanical polishing layer passing through the gap; a calibrating sanding belt driver, wherein the calibrating sanding belt driver is in mechanical communication with the drive roller to facilitate movement of the calibrating sanding belt; wherein the calibrating sanding belt is trained around the non-drive roller and the drive roller; wherein the at least two non-drive roller bearings facilitate the rotational movement of the non-drive roller about a non-drive roller axis of rotation, $A_{ndr}$; and, wherein the at least two drive roller bearings facilitate the rotational movement of the drive roller about a drive roller axis of rotation, $A_{dr}$;

wherein the drive roller axis of rotation, $A_{dr}$ is substantially parallel to the transport feed roller axis of rotation, $A_{tfr}$;

placing the chemical mechanical polishing layer on the transport belt;

feeding the chemical mechanical polishing layer through a gap between the transport belt and the calibrating sanding belt;

wherein the polishing surface comes into contact with the calibrating sanding belt;

wherein the at least two drive roller bearings are biased such that their radial clearance is disposed on the same side of the drive roller opposite the side of the drive roller that is closest to the chemical mechanical polishing layer as the chemical mechanical polishing layer passes through the gap;

wherein the gap is less than the initial average thickness, $T_{IA}$, of the chemical mechanical polishing layer;

wherein the chemical mechanical polishing layer exhibits a final average thickness, $T_{FA}$, after passing through the gap; and, wherein the final average thickness, $T_{FA}$, is less than the initial average thickness, $T_{IA}$.

2. The method of claim 1, wherein the at least two drive roller bearings are radial ball bearings.

3. The method of claim 1, wherein the calibrating sanding belt has an abrasive surface exhibiting a grit size of 25 to 300 μm.

4. The method of claim 1, wherein the drive roller biasing bearing is a ball bearing.

* * * * *

UNITED STATES PATENT AND TRADEMARK OFFICE

CERTIFICATE OF CORRECTION

PATENT NO. : 9,108,293 B2
APPLICATION NO. : 13/561282
DATED : August 18, 2015
INVENTOR(S) : Nunley, Jr. et al.

It is certified that error appears in the above-identified patent and that said Letters Patent is hereby corrected as shown below:

Title Page, Item (75) Inventors, should read

-- (75) Inventors: John Henry Nunley, Jr., Elkton, MD (US); Andrew M Geiger, Newark, DE (US); Jeffrey Benedict, Townsend, DE (US); Kathleen McHugh, Alexandria, VA (US) --.

Signed and Sealed this
Twenty-first Day of June, 2016

Michelle K. Lee

Michelle K. Lee
*Director of the United States Patent and Trademark Office*